US006619320B2

(12) United States Patent
Parsons

(10) Patent No.: US 6,619,320 B2
(45) Date of Patent: Sep. 16, 2003

(54) ELECTRONIC METERING FAUCET

(75) Inventor: Natan E. Parsons, Brookline, MA (US)

(73) Assignee: Arichell Technologies, Inc., West Newton, MA (US)

( * ) Notice: Subject to any disclaimer, the term of this patent is extended or adjusted under 35 U.S.C. 154(b) by 73 days.

(21) Appl. No.: 10/011,423

(22) Filed: Dec. 4, 2001

(65) Prior Publication Data

US 2003/0102037 A1 Jun. 5, 2003

(51) Int. Cl.[7] ..... G05D 7/06

(52) U.S. Cl. ..... 137/624.11; 251/129.04; 137/801; 4/623

(58) Field of Search ..... 137/624.11, 624.12, 137/801; 251/129.04; 4/623, 406, 626

(56) References Cited

U.S. PATENT DOCUMENTS

| | | | | |
|---|---|---|---|---|
| 4,241,759 A | | 12/1980 | Billeter | |
| 4,457,452 A | | 7/1984 | Symmons | |
| 4,570,899 A | | 2/1986 | Kingham | |
| 4,653,534 A | | 3/1987 | Chung-Shan | |
| 4,823,414 A | | 4/1989 | Piersimoni et al. | |
| 4,991,819 A | | 2/1991 | Laube | |
| 5,062,453 A | * | 11/1991 | Saadi et al. | 137/624.11 |
| 5,125,621 A | | 6/1992 | Parsons et al. | |
| 5,295,654 A | | 3/1994 | Laube | |
| 5,427,351 A | | 6/1995 | Korfgen et al. | |
| 5,655,748 A | | 8/1997 | Regelbrugge et al. | |
| 5,927,328 A | | 7/1999 | Nelson et al. | |
| 6,408,881 B2 | * | 6/2002 | Lorenzelli et al. | 251/129.04 X |
| 6,425,415 B2 | * | 7/2002 | Lorenzelli et al. | 137/624.11 |

FOREIGN PATENT DOCUMENTS

| | | | | |
|---|---|---|---|---|
| WO | WO 01/20204 | * | 3/2001 | 251/129.04 |

* cited by examiner

*Primary Examiner*—Kevin Lee
(74) *Attorney, Agent, or Firm*—Cesari and McKenna LLP

(57) ABSTRACT

An electronic faucet has a housing adapted to seat against a support surface and defining an internal barrel having a bottom wall, a side wall and an open top. There is at least one fluid inlet extending through the bottom wall into the barrel, a fluid outlet in the side wall of the barrel, and a valve cartridge seated in the barrel. The cartridge includes a main valve for controlling fluid flow between the at least one inlet and the outlet, a pilot valve and a solenoid operator for opening and closing the pilot valve. A faucet head removably mounted to the housing covers the open top of the barrel, the faucet head including an activator which produces an output signal of a selected duration when approached by a user, and a control circuit which responds to the signal by activating the solenoid operator so as to open the pilot valve which thereupon opens the main valve. The valve cartridge is removable from the barrel while the housing remains seated against the support surface by separating the faucet head from the housing.

33 Claims, 6 Drawing Sheets

ELECTRONIC METERING FAUCET

This invention relates to an electronic metering faucet. It relates more particularly to a faucet of this type which is preferably activated by touch and/or proximity to the faucet and which has a consistent water delivery period over the life of the faucet.

BACKGROUND OF THE INVENTION

There are several different types of metering faucets in use today. Many are manually activated to turn on the water by pressing the faucet head and are hydraulically timed so that the water remains on for a set period of time after depression of the head. Some of these faucets have separate head allowing separate control over the hot and cold water. Other metering faucets mix the incoming hot and cold water streams and, when actuated, deliver a tempered output stream.

Also known is a manually activated metering faucet whose on-time is controlled electronically. Still other known faucets are activated electronically when the user positions a hand under the faucet. These faucets usually incorporate an infrared or ultrasonic transceiver which senses the presence of the user's hand and turns the faucet on so long is that the hand remains under the faucet.

The aforesaid hydraulically timed faucets are disadvantaged in that it is difficult to accurately control the on-time of the faucet over the long term because of mains pressure changes and foreign matter build up in the faucet which can adversely affect the hydraulic controls within the faucet. On the other hand, the known electronic faucets can not always discriminate between a user's hand and other substances and objects which may be brought into proximity to the faucet, e.g. a reflective object disposed opposite the faucet's infrared transceiver, soap build up on the faucet's proximity sensor, etc. Resultantly, those prior faucets may be turned on inadvertently and/or remain on for too long a time resulting in wastage of water.

Still other conventional metering faucets are relatively complicated and therefore costly to manufacture.

SUMMARY OF THE INVENTION

Accordingly, it is an object of the present invention to provide an improved electronic metering faucet.

Another object is to provide a faucet of this type which is electronically timed and maintains its timing accuracy over the life of the faucet.

A further object of the invention is to provide an electronic metering faucet which may be touch activated.

Still another object of the invention is to provide a self-contained battery operated electronic metering faucet which can operate for over three years between battery replacements.

Another object is to provide such a faucet which has a minimum number of moving parts.

A further object of the invention is to provide a touch activated electronic metering faucet which can be manufactured at relatively low cost.

Another object is to provide a faucet whose parts may be accessed quite easily for maintenance purposes.

Still another object of the invention is to provide a faucet of this general type which is activated by single touch sensor to produce a timed and tempered water stream.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, the metering faucet is a touch activated, electronically timed faucet that can deliver water at a selected temperature for a preset water delivery period which, unless reset, remains substantially constant, i.e. within 2%, over the faucet's life span. The faucet includes a simple non-water-contacting housing or encasement which is adapted to be secured to a sink or countertop. Supported in the housing is a single cartridge containing most of the hydraulic components of the faucet including a solenoid-actuated valve which controls the delivery of water from hot and cold water lines to a single outlet at the end of a faucet spout formed by the housing. The housing or encasement also supports a stationary faucet head which contains all of the electrical components necessary to actuate the valve for a selected period of time after a user's hand touches or is moved into close proximity to a selected target area on the head.

As we shall see, the faucet includes provisions for preventing inadvertent faucet activation by non-environmental factors such as soap build up, contact by paper towels, etc., as well as accidental human contact. This is accomplished by dynamically adjusting in real time the faucet's activation sensitivity depending upon the prevailing conditions. Once activated, the faucet will deliver a stream of water at a set temperature for a predetermined time period. At the end of that period, the faucet's internal controls will issue a shut-off command which positively shuts off the faucet's solenoid valve.

Further as we will come apparent, the faucet is designed so that its components can readily be made and assembled and be accessed quiet easily by maintenance personnel for repair purposes. Still, the faucet can be made in quantity at a relatively low cost.

BRIEF DESCRIPTION OF THE DRAWINGS

For a fuller understanding of the nature and objects of the invention, reference should be made to the following detailed description taken in connection with the accompanying drawings, in which.

DESCRIPTION OF THE PREFERRED EMBODIMENT

Figures 1, 2:
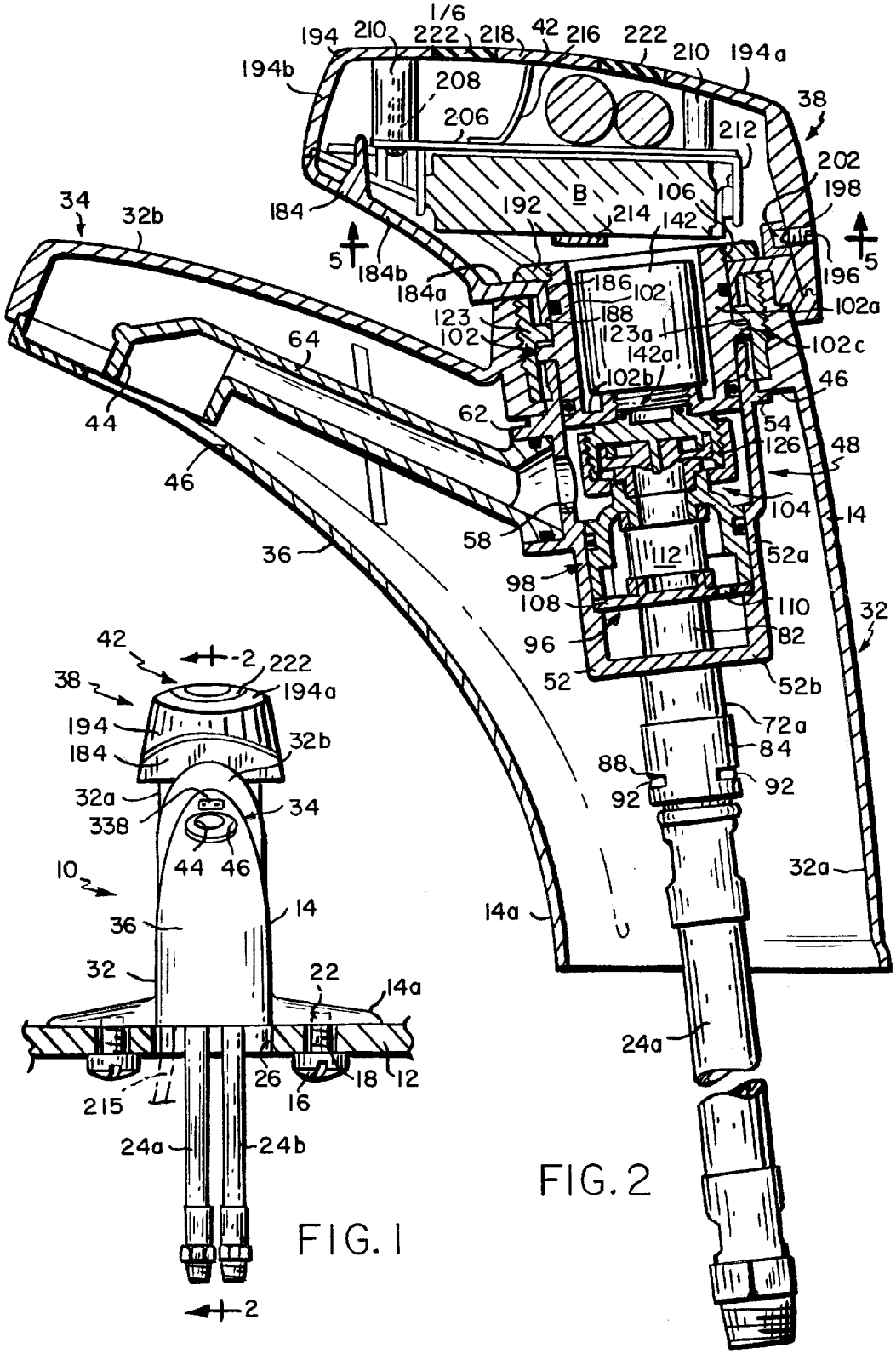
FIG. 1 is a front elevational view with parts in section showing a faucet incorporating the invention installed on a countertop.
FIG. 2 is a sectional view on a larger scale taken along line 2—2 of FIG. 1.

Referring to FIG. 1, the subject faucet 10 is shown mounted to countertop 12. The faucet includes a housing or encasement 14 having a more or less semicircular flange 14*a* at its lower end. Fasteners 16 inserted through holes 18 in countertop 12 are threaded into holes 22 in flange 14*a* to secure the faucet to the countertop. Faucet 10 also includes flexible hot and cold water lines 24*a* and 24*b* which extend from the lower end of housing 14 through a large opening 26 in countertop 12. These water lines adapted to be coupled to hot and cold water mains.

As shown in FIGS. 1 and 2, the faucet housing 14 actually consists of a shell-like part 32 forms an upright main body portion 32*a* (including flanges 14*a*) and the upper portion 32*b* of a spout extending out from the main body portion 32*a*. The open front of main body portion 32*a* and the underside of the spout portion 32*b* are normally closed by a removable cover plate 36 clipped or otherwise secured to the edges of portions 34*a* and 34*b*.

Faucet 10 also has a stationary head or up 38 mounted to the top of housing 14. Head 38 incorporates a touch sensor shown generally at 42 which, when touched, activates faucet 10 so that a stream of tempered water issues from an outlet 44 centered in an opening 46 provided in the cover plate 36 near the end of spout 34.

As best seen in FIG. 2, the upper end segment of the main body portion 32*a* has a thickened internally threaded wall forming a circular ledge 46 which functions as a stop for a cylindrical cartridge shown generally at 48. Cartridge 48 includes a side wall 52*a*, a bottom wall 52*b*, the top of the cartridge being open. A circular flange 54 extends out from side wall 52*a* and that flange is adapted to seat against ledge 46. The cartridge is held in place within the shell portion 32*a* by a bushing 56 which is screwed down into the open top of main body portion 32*a*.

An opening 58 is provided in the side wall 52*a* of cartridge 48 and an exterior collar 62 surrounds that opening into which is press fit one end of a conduit 64 which extends within the upper spout portion 32*b*. The other end of that conduit constitutes the faucet outlet 44. Preferably, there is sufficient clearance between the outlet 44 and the edge of opening 46 in the cover plate 36 to permit a conventional aerator (not shown) to be installed at outlet 44.

Figure 3:
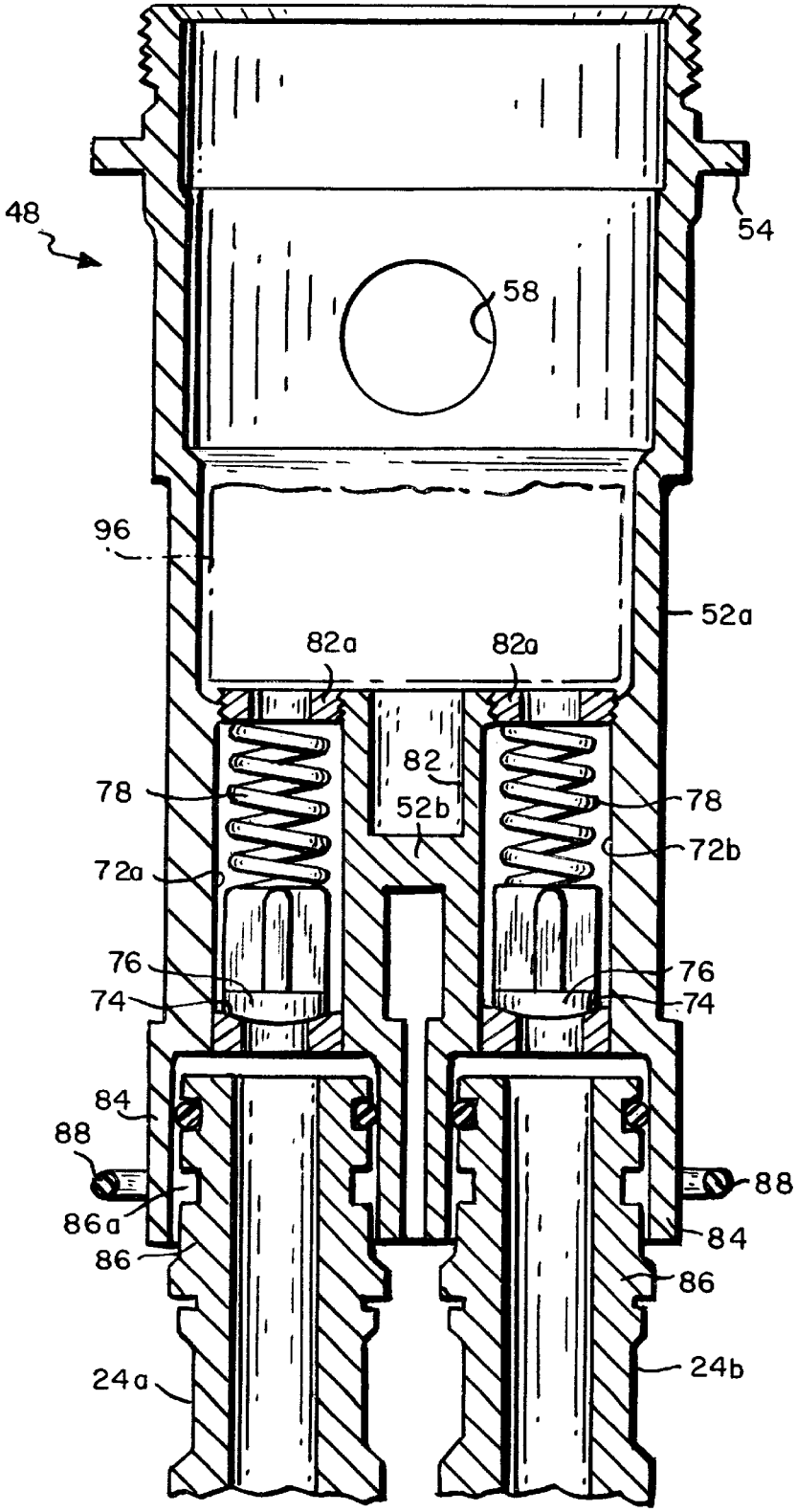
FIG. 3 is a fragmentary sectional view on a still larger scale showing a portion of the FIG. 2 faucet in greater detail.

Referring to FIGS. 2 and 3, cartridge 48 includes a pair of side by side inlet conduits 72*a* and 72*b* which extend down from the cartridge bottom wall 52*b*. Formed midway along each such conduit is an annular valve seat 74 for seating vertically moveable valve member 76. Each valve member is biased against its seat by a coil spring 78 seated within a sleeve 82 extending up from a cartridge bottom wall 52*b* within the cartridge. Each spring 78 is compressed between the upper end of the corresponding valve member 76 and a stop 82*a* provided at the upper end of each sleeve 82.

The lower end segment of the cartridge conduit 72*a* forms a female connector 84 which is arranged to receive a corresponding male connector 86 provided at the upper end of the water line 24*a*. The illustrated connector 86 is a conventional quick release connector which is held in place by a C-clip 88 whose arms extend through slots 92 in the opposite sides of connector 84 and engage in a groove 86*a* in male connector 86.

The cold water line 24*b* is connected in a similar fashion to conduit 72*b* of cartridge 48. It is thus apparent from FIG. 3 that each of the hot and cold water lines 24*a*, 24*b* conducts water into cartridge 48 via a check valve so that water can flow into, but not out of, cartridge 48 via conduits 72*a* and 72*b*.

Figure 4:
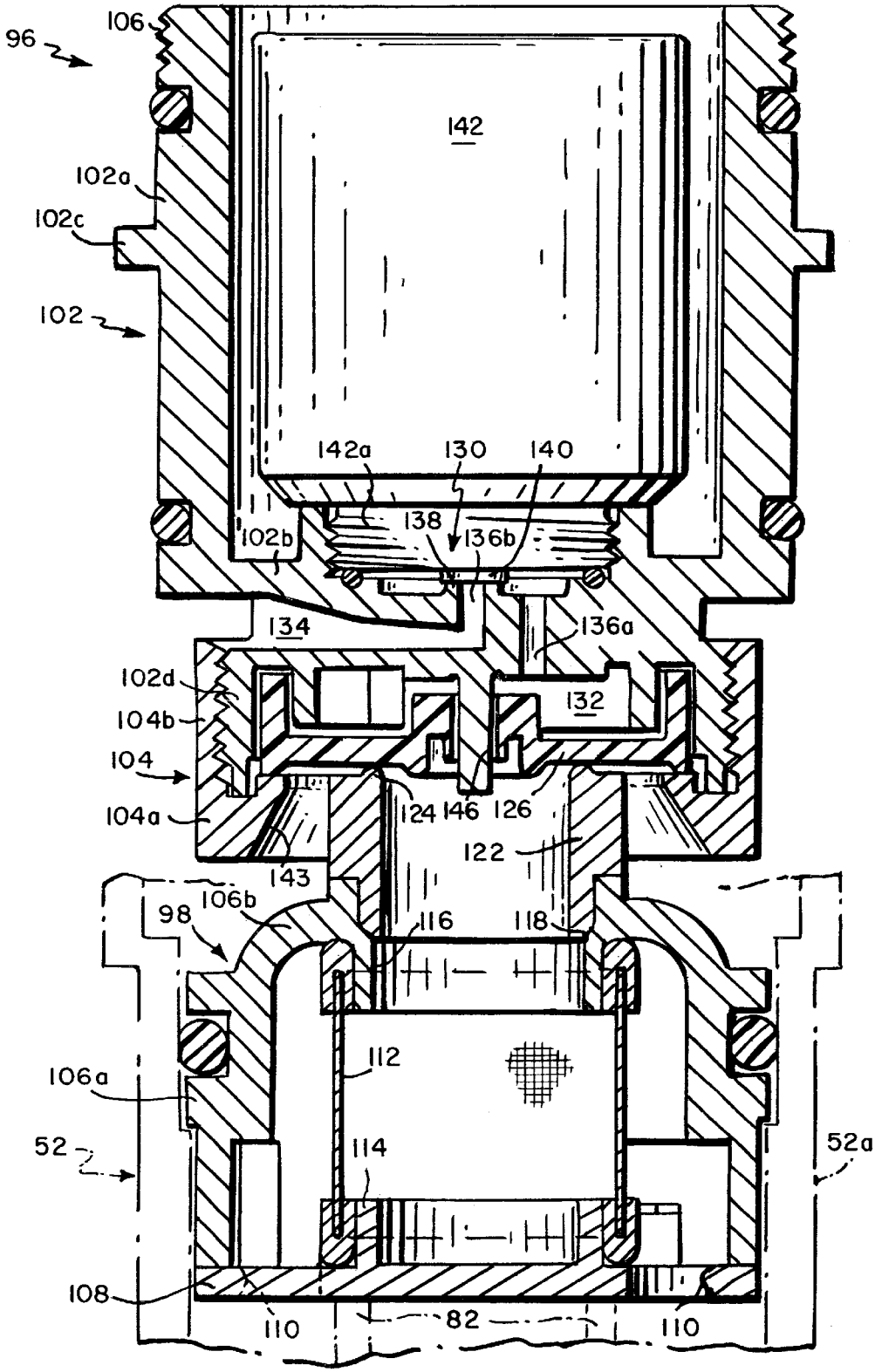
FIG. 4 is a similar view on an even larger scale of another portion of the FIG. 2 faucet.

The cartridge 48 contains an electromechanical valve assembly shown generally at 96 which controls the flow of hot and cold water from lines 24*a* and 24*b* to the faucet outlet 44. As shown in FIGS. 2 to 4, assembly 96 sits on the two sleeves 82 projecting up from the cartridge bottom wall 52*b*. As specified in FIG. 4, the valve assembly 96 comprises lower filter housing shown generally at 98, an upper valve housing in 102, the two housings being releasably connected together by coupling 104. The housing 98 is shaped generally like an inverted cup. It has a side wall 106 and a top wall 106*b*. The open bottom of the housing is substantially closed by a circular metering plate 108 which is the part of the valve assembly that actually sits on the sleeves 82 extending up from the cartridge bottom wall 52*a*. The metering plate 108 does have metering holes 110 which are aligned with sleeves 82 so that hot and cold water is conducted via those holes from the water lines 24*a* and 24*b* to the interior of housing 98. As shown in FIG. 4, housing 98 contains a vertically oriented filter element 112 whose opposite ends are captured by an upstanding wall 114 formed in plate 108 and a second wall 116 which extend down from the housing top wall 106*b*. There is also an opening 118 near the housing top wall 106*b* that is ?? to limitation with the interior of the tubular neck 122 extending up around the housing top wall 106*b*.

The interior of housing 98 is configured so that hot and cold water entering the housing is conducted to the periphery of the filter element 112 whereupon the water flows into the interior of the filter element and out of the filter element through the large opening 118 and neck 122. The flow rates of the hot and cold water into the housing is controlled by the relative sizes of the metering holes 110 and the metering plate 108. The hot and cold water are mixed within housing 98 so that the water leaving the housing through the neck 122 has a selected temperature. That temperature may be changed by substituting different meter in plates 108 in the valve assembly.

Sown in FIG. 4, the upper end of neck 122 is shaped leftwardly extending circular valve seat 124. When housing 98 is connection to housing 102 by coupling 104, a valve member 126 in the form of a diaphragm is adapted to move and down with respect to valve seat 124 to control the flow of water out of the neck 122. A valve member 126 is supported within the valve housing 102 as we will describe in further detail presently.

Still referring to FIG. 4, the upper valve housing 102 has a cylindrical side wall 102*a* and a relatively thick bottom wall 102*b* the top of the housing being open. A flange 104 encircles side wall 102*a* about a third of the way down on that wall. Also an upper end segment of the side wall is threaded as shown at 106.

Housing 102 is arranged to contain a cylinder solenoid 110 having a exterially threaded neck 110*a* which is threaded into a collar 112 which extends up from the housing bottom wall 102*b*. Solenoid 110 has an armature 120*b* which extends down through the housing bottom wall 102*b* and is connected to the valve member 126 which is part of a more or less conventional pilot valve assembly, e.g. of the type described in U.S. Pat. No. 5,125,621, the contents of which is hereby incorporated herein by references. When solenoid 110 is energized, its armature 110*b* is retracted thereby moving the valve member 126 away from valve seat 124 allowing water to flow from the filter housing 98 past the valve seat to the opening 58 (FIG. 3) in cartridge 48 and thence via conduit 64 to the faucet outlet 44 shown in FIG. 2. On the other hand, when the valve member 126 is seated against valve seat 124, no water flows from the faucet.

As shown in FIG. 2, the valve assembly 96 is positioned in cartridge 48 so that the meter in plate 108 sits on the sleeves 82 with the metering holes 110 in that plate is aligned with those sleeves. In this position of the cartridge, the flange 104 of the valve housing 102 seats on the upper edge of the cartridge. To retain the valve assembly in this position, an exterially threaded bushing 180 is screwed down into the upper end segment of the main body portion 32 of housing 32. Bushing 180 has a radially inwardly extending flange 180*a* which bears down against the flange 104 of the valve housing 102 to hold the valve assembly in place within the cartridge 48. As shown in FIG. 2, when seated, the upper end of bushing 108 is flush with the upper end of the housing main body portion 32*a* and the threaded upper end 106 of the valve housing 102 extends appreciably above the bushing.

Figure 5:
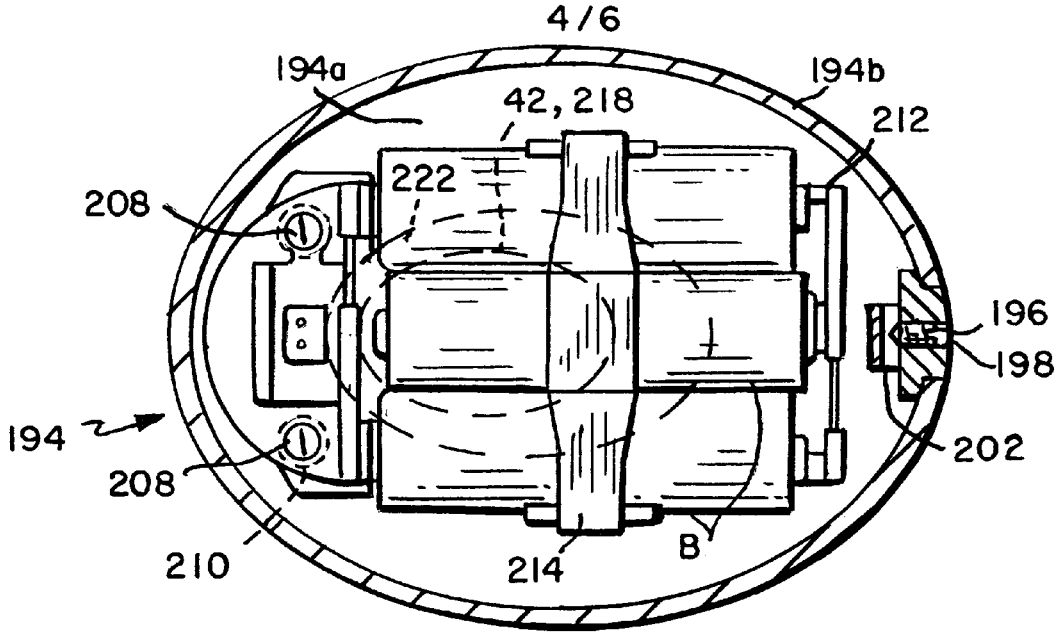
FIG. 5 is a sectional view taken along the line of 5—5 of FIG. 2.

Referring now to FIGS. 2 and 5, the faucet head or cap 38 is secured to the upper end of the valve housing 32. Head 38 comprises a lower housing portion 184 comprising a bottom wall 184*a* and a side wall 184*b* which flares out and up above the faucet spout 34. A large hole 186 is provided in bottom wall 184*a* so that the housing portion 184 can be seated on the top of the main body portion 32*a* and bushing 180. A collar 108 surrounding opening 186 extends down between the side wall 102*a* of valve housing 102 and bushing 108 with the bottom of that collar resting on the flange 180*a* to help stabilize head 38. The housing portion 184*b* is held in place by an internally threaded ring 192 which is turned down onto the threaded upper end 106 of the valve assembly housing 102*a*.

Faucet head 38 also includes an upper housing portion 194 in the form of a cap. Portion 194 includes a top wall 194*a* and an all-around side wall 194*b* whose lower edge interfits with the upper edge of housing portion 184 so that the head form a hollow enclosure. Housing portion 194 is releasably secured to housing portion 84 by a set screw 196 which is screwed into a threaded hole 198 in the housing portion side wall 194*b* at the rear of the faucet. When tightened, the set screw 196 engages a detent 202 formed at the rear of the housing portion 184 as shown in FIG. 2.

As noted above, the faucet head 38 contains the electrical components necessary to operate the faucet's valve assembly 96. More particularly, as shown in FIGS. 2 and 5, a printed circuit board 206 is secured by threaded fasteners 208 to a pair of posts 210 extending down from the top wall 194*a* of the upper housing section 194. Secured to the underside of the printed circuit board 206 is a battery holder 212 which supports a plurality of batteries B and electrically connects those batteries to terminals on the printed circuit board 206 so as to power the various electrical components on the printed circuit board to be described later. The batteries B may be releasably secured to the battery holder 212 by a strap 214 or other suitable means.

As best seen in FIG. 2, an electrically lead 216 extends up from circuit board 206 to a metal pad 218 incorporated into a top wall 194*a* of the upper housing section 194. Pad 218 is surrounded by an electrically insulating ring 222 which electrically isolates the pad from the remainder of top wall 194*a*. That pad 218 constitutes the faucet's touch sensor 42 described at the outset. It will be apparent from FIG. 2 that all of the electrical components in head 38 may be accessed simply by loosening the set screw 196 and separating the upper housing 194 from section 184.

Figure 6:
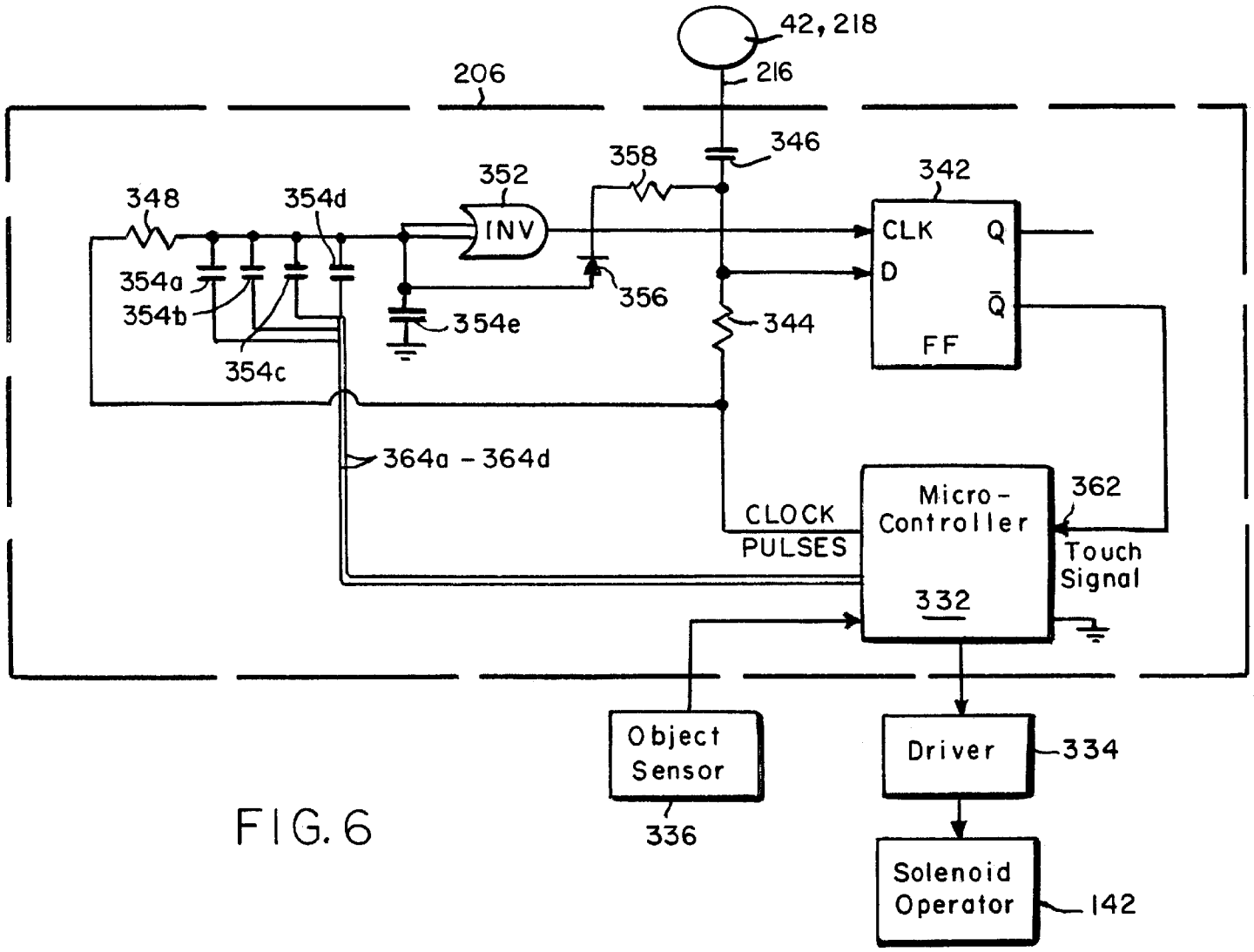
FIG. 6 is block diagram showing the control circuitry in the FIG. 1 valve.

Referring now to FIG. 6 which shows the major electrical components on printed circuit board 206 which control the operation of faucet 10. As shown there, a microcontroller 332 operates a driver 334 which powers the solenoid 110 of the valve assembly 96. In some faucet embodiments, the microcontroller 332 may also receive an input from an object sensor 336 which is part of a proximity transceiver 338 mounted to the faucet spout cover plate 336 just above opening 46 therein as shown in phantom in FIG. 1. Transceiver 338 may be of a known infrared type commonly found on automatic faucets and consisting of a light emitting diode which directs a beam of infrared light downward from the spout, and an infrared sensor which detects light reflected from a hand or other object positioned under the faucet spout.

The circuit in FIG. 6 also includes a D-type flip-flop 242 whose D input receives pulses from microcontroller 332 by way of a resistor 344. That D input of the flip-flop is also connected via a capacitor 346 to the metal pad 218 comprising touch sensor 242. The Q output of a D-type flip-flop is the value that it's D input had at the time of the last leading edge of a pulse train applied to the flip-flops' CLOCK (CLK) input terminal.

Normally, when a user has placed his hand or finger in the vicinity of the touch sensor 42, the Q output of flip-flop 342 remains asserted continuously for the following reasons. The microcontroller 332 produces a rectangular-wave clock signal which is applied via resistor 334 to the D input terminal of flip-flop 342. That same signal is applied to a resistor 348 and an inverter 352 to the CLK input terminal of flip-flop 342. However there is a delay in the transmission of that pulse from microcontroller 332 to the CLK input terminal of flip-flop 342 because of the presence of a plurality of capacitors 354*a* to 354*e* which capacitively load the input circuit of converter 352 as will be described in more detail below. The value at the D input port of flip-flop 342 therefor stabilizes at the higher level before the rising leading edge of the clock pulses from inverter 352 reach the flip-flop's CLK input terminal. Therefore, the Q output of the flip-flop is high. However this situation changes when a user's hand is very close to the touch sensor 42 or actually touches it. This hand contact or proximity has the effect of capacitively loading the D input terminal of flip-flop 342; it may typically result in a capacitance on the order of 300 pF between sensor 42 and ground.

The inverter input is also connected via a diode 356 and a resistor 358 to the D input terminal of flip-flop 342. This imposes a delay at the D input 342 of flip flop affecting the pulse level to the extent that the edge of the clock signal applied to the clock input of the flip-flop now occurs before the D input has reached the high level. Therefore, the flip-flip's Q output remains low. The microcontroller receives the compliment of that Q output at its input 362 and thereby infers that a user has touched the sensor 42.

However, various environmental factors can also load the touch sensor 42. Therefore, in a preferred embodiment of the invention, the micorcontroller 332 so adjusts the circuit's sensitivity as to minimize the likelihood of erroneous human-contact indications. As does this by employing lines 364*a* to 364*e* to ground selected one of the capacitors 354*a* to 354*e*, while allowing the others to float. By selectively grounding these capacitors, the microcontroller can choose among 16 different sensitivity levels. As will be seen presently, this sensitivity adjustment is done dynamically to account for changing environmental conditions or a user's nervousness or hesitancy for being considered as multiple inputs to the faucet's touch sensing circuitry. The microcontroller 332 monitors the output of flip-flop 342 and changes the sensitivity level of the sensing circuit according to an adapting or dynamic sensing algorithm to be discussed in connection with FIG. 7.

The microcontroller 332 operates, as many battery-operated do, in a sleep/wake sequence. Most of the time, the controller is "asleep": it receives only enough power to maintain the state of certain volatile registers, but it is not being clocked or executing instructions. This sleep state is interrupted periodically, say, every 120 ms, with a "wake" state, in which it executes various subroutines before returning to its sleep state. The duration of the wake state is typically a very small fraction of the controller's sleep state duration.

Figure 7:
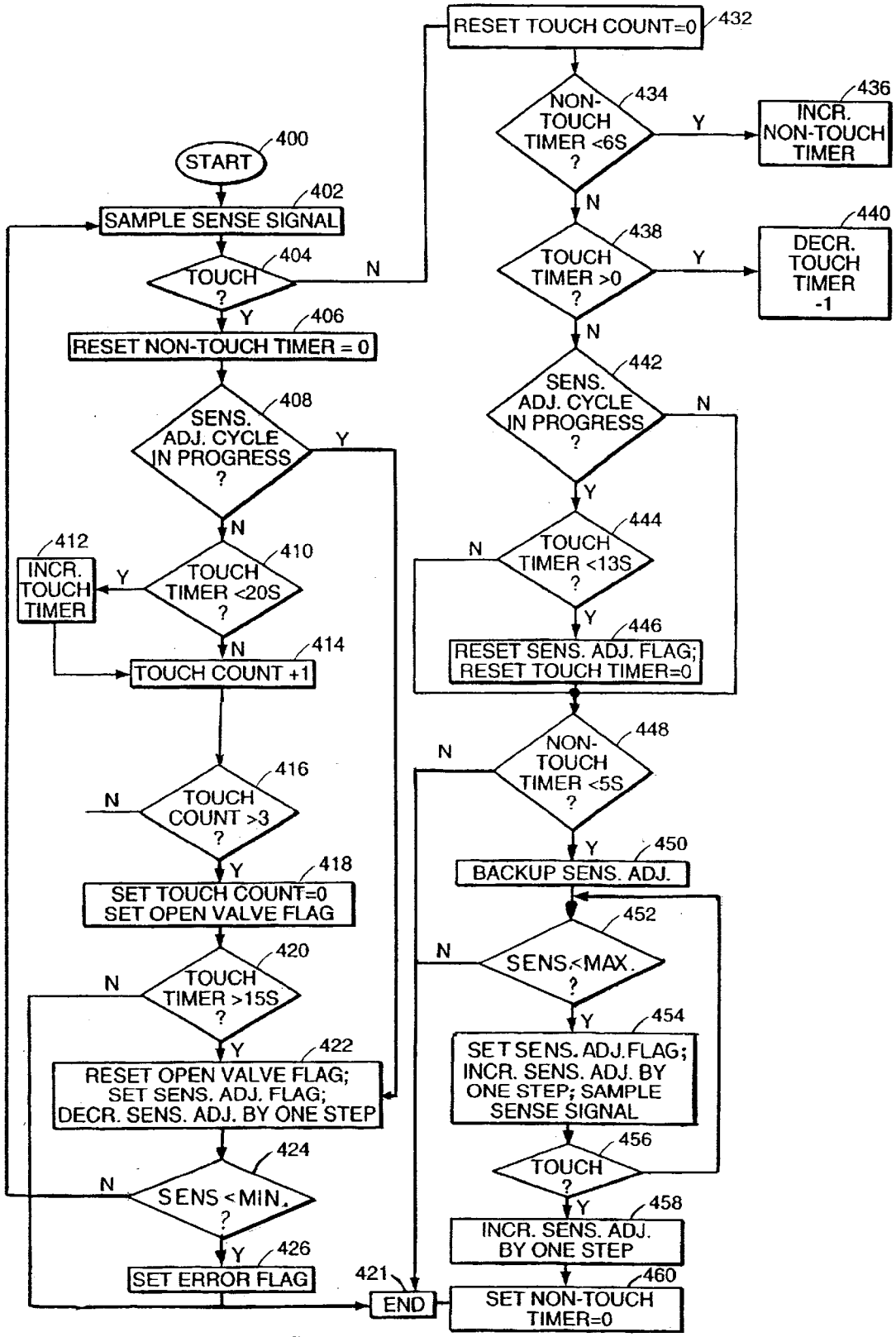
FIG. 7 is a flow chart showing the operation of the valve.

One of the routines performed by the microcontroller 332 when it awakens is the sensitivity adjustment routine depicted in the FIG. 7 flow chart. In FIG. 7, block 400 represents the start of that routine and block 402 represents sampling the value of the signal applied to the microcontroller sense input 362 shown in FIG. 6. If because of the operation just described, that input's level indicates that a user is touching the touch sensor 42, the controller sets to zero a non-touch timer representing how long it has been since the faucet detected a person's touch at touch sensor 42. Blocks 404 and 406 represent this subroutine. As will be explained presently, the non-touch timer is used to determine when to make a sensitivity adjustment.

Although a touch detection is usually the basis for causing the faucet valve to open, the system is sometimes in a mode in which it is used instead to determine when to adjust sensitivity. Block 408 represents reading a flag to determine whether a sensitivity adjustment or a touch cycle is currently in progress. If it is not, the routine proceeds to increment a touch timer if that timer has not already reached a maximum value. Blocks 410 and 412 represent that incrementing operation.

The touch timer indicates how long a touch detection has been reported more or less continuously. As will be seen presently, an excessive touch duration will cause the system to infer that the touch detection resulted from something other than a human user and that the system's sensitivity should therefore be reduced to avoid such erroneous detections. Before the system test that duration for that purpose, however, it first performs a de-bounce operation, represented by blocks 414 and 416, in which it determines whether the number of successive touch detections exceeds three. If it has, then at block 418, the system resets the touch count to zero and sets a flag that will tell other routines, not discussed here, to open the valve. If these three detections have not occurred in a row, on the other hand, the system does not yet consider the touch valid and that flag is not set.

The system then performs a test, represented by block 420 to determine whether it should reduce the system's sensitivity. If the touch timer represents a duration less than seconds, the routine simply ends at block 421. Otherwise, it resets the flag that would otherwise cause other routines to open the valve. It also sets a flag to indicate that the system is in its sensitivity or adjustment mode and causes a decrease in sensitivity by one step. That is, it so changes the combination of capacitors 354*a* to 354*e* in the circuit of FIG. 6 that are connected to ground that the signal applied to the CLK input of flip-flop 342 is increased. Resultantly, a greater loading of the touch sensor 42 will be required for the flip-flop 342 to indicate that a touch has occurred. Block 422 represents taking those actions.

It may occur in some situations that the sensitivity was already as low as it could go. If that happens, the system is in an error condition, and subsequent circuitry should take appropriate action. This is determined at block 424. If it has, then the routine sets an error flag as indicated at block 426 and the routine ends at block 421. If the system is not in that error condition, the routine performs the steps at blocks 406 and 408 as before. This time, however, the sensitivity-adjustment flag is set so that the test at block 408 results in the routines jumping to the step at block 422 to repeat the sensitivity-reduction sequence just described.

Referring to the right hand side of FIG. 7, if the block 404 step yields an indication that no touch has been detected by the touch sensor 42, the routine resets the touch counter to zero as indicated at block 432.

As was described previously, an extended period of touch detection will cause the system to reduce its sensitivity, on the theory that detection for so long a period could not have been the result of a legitimate human contact. If contact absence has been indicated for an extended period, on the other hand, it is logical to conclude that the current capacitive loading provided by capacitors 354*a* to 354*e* (FIG. 6) is consistent with contact absence but that any greater capacitance is likely to be an indication of legitimate contact of the touch sensor 42. The system therefore responds to an extended period of detection absence by increasing the sensitivity to a value just below one that would cause touch detection with the currently prevailing capacitance loading by capacitors 354*a* to 354*e* (FIG. 6).

To this end, the routine in FIG. 7 increments the non-touch timer if that timer has not exceeded a selective maximum value, e.g. 6 seconds. Blocks 434 and 436 represent that operation. Since this point in the routine is reached as a result of the indication of block 404 that no touch has been detected, it would seem logical to reset the touch timer to zero. However, to make the illustrated system more robust to noise that could cause a non-contact indication to occur momentarily in the midst of an extending contact, the illustrated arrangement instead merely decrements the touch timer towards zero if it has not yet reached that value. Blocks 438 and 440 represent the decrementing of that timer.

Now if such touch-timer decrementing has occurred enough times for that timer's value to have been reduced by a selected value, say, two seconds, the system can rule out the possibility that the lack of touch detection was simply caused by noise. Therefore, since the system has assumed the sensitivity-adjustment mode as a result of that timer having reached 15 seconds, its count having been decremented to 13 seconds, can be considered as an indication that contact with the touch sensor 42 has actually ended. The touch timer is therefore set to zero and the system leaves the sensitivity-adjustment mode as indicated by blocks 442, 444 and 446.

At block 448, the routine then tests the non-touch timer to determine whether the absence of touch detection has lasted long enough to justify trying a sensitivity increase. If not, the routine ends at block 421. Otherwise, the routine makes a back-up-copy of the current sensitivity at block 450 and then proceeds to determine whether an increase in sensitivity will cause a touch detection. Of course, the sensitivity cannot be increased if it is already at its maximum value so at block 452, the routine goes to END block 421. However if the sensitivity is not yet at its maximum value, it is increased by one step as indicated at block 458. This is part of the sensitivity-adjustment so that that step includes setting the sensitivity-adjustment mode flag. The microcontroller 332 (FIG. 6) then samples the output of flip-flop 342 again, as indicated at block 454 and, as block 456 indicates branches on the result. In particular, if a sensitivity increase has not resulted in an apparent touch detection, then the sensitivity is increased again (because it has not reached a maximum), and the output of flip-flop 342 is sensed again.

This continues until an apparent touch is detected. Since the sensitivity adjustment scheme is based on the assumption that there really is no valid contact at touch sensor 42, the sensitivity is thus reduced back by one step so that it is at the highest level that yields no touch indication. Block 458 represents this operation.

Now that a sensitivity-adjustment has been made, the non-touch timer is reset to zero as indicate at block 460 so that the sensitivity will not be reset again on the next controller wake cycle. The routine then ends at block 421.

What is claimed is:

1. An electronic faucet comprising a housing adapted to seat against a support surface and defining an internal barrel having a bottom wall, a sidewall and an open top;

at least one fluid inlet extending through the bottom wall into the barrel;

a fluid outlet in the sidewall of the barrel;

a valve cartridge seated in said barrel through the open top thereof, said cartridge including a valve for controlling fluid flow between said at least on inlet line and said outlet, and a solenoid actuator for opening and closing the valve;

means for releasably retaining the valve cartridge in the barrel;

a faucet head removably mounted to the housing and covering the open top of the barrel, said faucet head including a wall;

a proximity sensor at the faucet which produces an output signal of a selected duration and approached by a user's extremity, and a control circuit in the faucet head which responds to said signal by activating said solenoid so as to open the valve, said valve cartridge being removable from the barrel while the housing remains seated against said support surface by separating the faucet head and retaining means from the housing.

2. The faucet defined in claim 1 and further including a check valve releasably retained in each inlet line, each check valve being accessible from the barrel when the cartridge is removed from the barrel.

3. The faucet defined in claim 1 and further including a spout having a first end connected to said fluid outlet and a second end spaced laterally from the barrel.

4. The faucet defined in claim 3 and further including a second proximity sensor located adjacent to the second end of the spout and delivering a second output signal to said control circuit so long as the second sensor sensors a user's extremity and when that control circuit responds to said second signal by activating the solenoid to open the valve.

5. The faucet defined in claim 1 wherein said proximity sensor is a capacitive-type sensor.

6. The faucet defined in claim 5 wherein said sensor includes an electrically conductive pad incorporated into said wall of the faucet head and surrounded by electrically insolating material, and an electrical lead connecting the pad to said control circuit.

7. The faucet defined in claim 1 wherein the faucet head contains a battery for energizing the control circuit and solenoid.

8. The faucet defined in claim 1 wherein housing comprises a shell having an open front and adapted to seat against the support surface;

each inlet line includes a fitting adjacent to the barrel for coupling to water mains;

the barrel is releasably supported in the shell so that the barrel may be separated from a water mains and removed from the shell from the front opening thereof, and the housing also includes a removable cover member for covering the open front of the shell.

9. The faucet defined in claim 1 wherein the faucet includes means for connecting the control circuit to a power source.

10. The faucet defined in claim 1 wherein a faucet head includes a shell removably mounted to the housing and having an open top, and a cap removably secured to the shell to provide access to the control circuit in the faucet head, the proximity sensor being incorporated into the cap and including a spring contact connecting the proximity sensor to said control circuit.

11. The faucet defined in claim 1 wherein said valve cartridge also includes a fluid metering member upstream from the valve, said metering member having a metering oriface aligned with said at least one inlet line so as to meter the fluid flow through said faucet.

12. The faucet defined in claim 11 wherein the valve cartridge also includes a filter member in the flow path between the metering number and the valve.

13. The faucet defined in claim 1 wherein the valve includes a pilot valve.

14. The faucet defined in claim 1 wherein said actuator is of a latching type.

15. The faucet defined in claim 14 wherein the latching actuator is of the isolated type.

16. An electronic faucet comprising a housing;

at least one fluid inlet line flowing extending into the housing;

a fluid outlet from the housing;

a solenoid valve in the housing controlling the fluid flow between said at least one inlet line and the outlet, and control means for controlling the opening and closing of the valve, said control means including power supply means, and a control circuit for controlling the delivery from the power supply means to the valve, said control circuit comprising a touch pad accessible from outside the housing, a detector connected to the touch pad for producing a touch signal when the touch pad is touched, and a controller responsive to the touch signal for delivering power to the valve so as to open the valve for a selected time duration.

17. The faucet defined in claim 16 wherein the controller includes means in the housing for adjusting said time duration.

18. The faucet defined in claim 16 wherein the controller includes means for counting touch signals and delivering power to the valve only after a selected number of touch signals have been counted.

19. The faucet defined in claim 16 wherein the controller includes timing means for measuring the duration of each touch signal, and means for inhibiting the delivery of power to the valve if the touch signal persists for more than a selected time duration.

20. The faucet defined in claim 16 wherein the control circuit includes means for measuring the duration of each touch signal, and a means for decreasing the sensitivity of the detector to a succeeding touch pad touch when the duration of the touch signal exceeds a selected amount.

21. The faucet defined in claim 16 wherein the control circuit includes means for measuring the time interval between touches of the touch pad, and means for increasing the sensitivity of the detector to a succeeding touch pad touch when the time interval between touches of the touch pad exceeds a selected amount.

22. The faucet defined in claim 16 wherein the touch pad is an electrically isolated capacitor plate mounted to said housing, and the detector detects the capacitance added to the control circuit when the touch pad is touch.

23. The faucet defined in claim 22 wherein the detector comprises a D-type flip-flop having the D input, a CLOCK input and whose output is said touch signal; the plate is capacitively coupled to said D input, and the control circuit includes an adjustable delay circuit controlled by a controller and the controller supplies clock pulses to said D input and by way of the delay circuit to said CLOCK input.

24. The faucet defined in claim 22 wherein the housing includes a hollow head, and the control means are contained within said head.

25. The faucet defined in claim 24 wherein the power source includes at least one battery.

26. The faucet defined in claim 24 wherein the power source includes an electrical connector for connection to a power supply.

27. The faucet defined in claim 16 wherein the solenoid valve is of a latching type.

28. The faucet defined in claim 27 wherein the solenoid valve is of an isolated type.

29. The faucet defined in claim 16 wherein the housing includes a hollow head having a wall;

the control circuit is contained within the head, and the touch pad comprises an electrically isolated capacitor plate mounted in said wall and connected by spring contact to said control circuit.

30. The faucet defined in claim 16 wherein further including a sensor for sensing the temperature of the fluid in the faucet and producing a corresponding temperature signal, and wherein the controller responds to said temperature signal by inhibiting delivery of power to said valve when the temperature exceeds a selected value.

31. An electronic faucet comprising a housing;

at least one fluid inlet line extending into the housing;

a fluid outlet from the housing;

a solenoid valve in the housing controlling the fluid flow between said at least one inlet line in the outlet, and control means for controlling the opening and closing of the valve, said control means including a power source, a control circuit for controlling the delivery of power from the power source to the valve, said control circuit including a touch pad accessible from outside the housing, a detector connected to the touch pad for producing successive touch signals upon successive touches of the touch pad, and a controller responsive to at least one of the succession of touch signals to deliver power to the valve so as to open the valve for a selected time duration, said control circuit including means for decreasing the means for adaptively adjusting the sensitivity of the detector to one of the succession of touch pad touches depending upon the time duration of the time interval from the previous touch signal in the succession of touch signals.

32. The faucet defined in claim 31 wherein the controller is programmed to deliver power to the valve only after the occurrence of a selected number of touch signals.

33. The faucet defined in claim 32 wherein the controller is programmed to inhibit the delivery of power to the valve if the duration of one of the succession of touch signals exceeds a selected time.

* * * * *